US006378478B1

(12) United States Patent
Lagies

(10) Patent No.: US 6,378,478 B1
(45) Date of Patent: Apr. 30, 2002

(54) CONTROL DEVICE FOR CAMSHAFT SYSTEMS

(75) Inventor: Dietmar Lagies, Wolfsburg (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 09/786,562

(22) PCT Filed: Apr. 22, 1999

(86) PCT No.: PCT/EP99/02717

§ 371 Date: Mar. 5, 2001

§ 102(e) Date: Mar. 5, 2001

(87) PCT Pub. No.: WO00/14387

PCT Pub. Date: Mar. 16, 2000

(30) Foreign Application Priority Data

Sep. 5, 1998 (DE) ..... 198 40 659.2

(51) Int. Cl.[7] ..... F01L 1/02; F02B 75/22

(52) U.S. Cl. ..... 123/90.31; 123/54.4

(58) Field of Search ..... 123/90.27, 90.31, 123/54.4; 74/567

(56) References Cited

U.S. PATENT DOCUMENTS 4,617,882 A * 10/1986 Matsumoto ..... 123/90.31
4,671,223 A 6/1987 Asano et al. ..... 123/90.31
4,841,789 A 6/1989 Ochiai ..... 74/15.63
5,014,655 A * 5/1991 Ampferer ..... 123/90.31
5,033,421 A * 7/1991 Shimada et al. ..... 123/90.27
5,063,895 A 11/1991 Ampferer ..... 123/196 R
5,216,989 A * 6/1993 Iwata et al. ..... 123/90.31

OTHER PUBLICATIONS

Article entitled "Der Porsche 4,5–1–Rennsportwagen Typ 917" taken from ATZ 71 (1969) 9 pp. 314–320.

Article entitled "The Fabulous Forsche" by Peter Hinsdale pp. 41–46.

* cited by examiner

*Primary Examiner*—Weilun Lo
(74) *Attorney, Agent, or Firm*—Cohen, Pontani, Lieberman & Pavane

(57) ABSTRACT

A control device for camshaft systems of an internal combustion engine with n banks of cylinders arranged in a V-shaped configuration. The control device has a distribution system with a first distributor gear which intermeshes with an output gear arranged on a crankshaft of the internal combustion engine. The distribution system has m<n secondary distributor gears which intermesh with the first distributor gear and transmit a driving force to the n camshaft systems of the n banks of cylinders through n endless-chain drives.

13 Claims, 6 Drawing Sheets

CONTROL DEVICE FOR CAMSHAFT SYSTEMS

BACKGROUND OF THE INVENTION

The invention relates to a control device for camshaft systems of an internal combustion engine with n banks of cylinders arranged in a V-shaped configuration, the control device having a distribution system with a first distributor gear, which intermeshes with an output gear arranged on a crankshaft of the internal combustion engine.

A central output of generic type for an internal combustion engine of a motorcycle is disclosed by U.S. Pat. No. 4,671,223. In this case a straightforward gear drive is produced, a separate distribution system being assigned to each camshaft system of one bank of cylinders. The gears of each distribution system are mounted in a respective frame. The straightforward gear drive has the disadvantage that it generates very loud noise. Furthermore, having a separate output line for each camshaft system makes this arrangement mechanically expensive, and it takes up a lot of space. A central output for the control device of an internal combustion engine for a motor vehicle would not be practically feasible with this system, since all cylinder banks would have to have at least one division. This would lead, however, to considerable mechanical weakening of the engine block, which with the torques and forces occurring in motor vehicles could not be tolerated.

A central control output is furthermore disclosed in the article "The Porsche 4.5-liter Racing Sports Car, Type 917" by H. Metzger, which appeared in the offprint from a German periodical, Automobiltechnische Zeitschrift (ATZ), Vol. 71 No. 9/12/1969, pages 313 to 320 for an air-cooled four-stroke engine with two flat rows of cylinders, which is designed especially for racing purposes. The drive to four camshafts comes from a central output gear on the crankshaft to both rows of cylinders, in each case by way of five straight-toothed gears on needle-roller bearings. In other words, a separate control device is assigned to each row of cylinders. The five gears arranged between crankshaft and each of the camshafts are in each case arranged in a gear housing, which can be bolted to a crankcase. This, too, is a straightforward gear drive, which has the aforementioned disadvantage that it generates considerable noise levels. In the case of a racing car for a Constructors' World Championship this may not be critical, but for a comfortable motor vehicle for day-to-day use in public road traffic it is unacceptable.

SUMMARY OF THE INVENTION

The object of the present invention therefore is to provide a simple control device of the above-mentioned type that takes up little overall space and overcomes the above-mentioned disadvantages.

To this end it is proposed, according to the invention, that the distribution system have m<n secondary distributor gears, which intermesh with the first distributor gear and transmit a driving force to the n camshaft systems of the n banks of cylinders through n endless-chain drives.

This has the advantage that all camshaft systems of respective cylinders can be driven by a single distribution system proceeding from the middle of the internal combustion engine, for example. This advantageously simplifies the mechanical construction of the control device and reduces the overall space required and the weight.

A particularly space-saving central output for the control device is obtained by arranging the output gear centrally on the crankshaft.

It is advisable if m=n−1 or m=n−2, it being particularly preferable if n=2, 3 or 4.

For ease of assembly the first and the secondary distributor gears are arranged in a common carrier, which when pre-assembled can be fixed to a crankcase of the internal combustion engine. For example, with a central output for the control device, bolting the carrier onto the crankcase provides additional reinforcement for the engine block, which is actually mechanically weakened by corresponding recesses required for the central output.

Simple assembly of the control device, for example in a recess in a crankcase for a central output, is achieved by providing a module that carries the endless-chain drive between each secondary distributor gear and each camshaft system. The module being pre-assembled so that it carries a chain sprocket, which can be frictionally and coaxially fitted to the respective secondary distributor gear, at one end and at least one camshaft gear on an opposite end, the endless-chain drive passing around the chain sprocket and the camshaft gear.

A suitable transmission ratio between the crankshaft and the respective camshaft system is effectively achieved by selecting a tooth ratio of the secondary distributor gear to the chain sprocket such that a crankshaft to camshaft system transmission ratio of 2:1 is obtained.

Secure guiding of the chain of the endless-chain drive is achieved in that the module has a U-shaped guide plate for the endless-chain drive on the idle strand side.

Reliable, frictional running of the chain of the endless-chain drive with low mechanical wear and low noise is achieved in that the module has a chain-tensioning fixture on the load strand side.

BRIEF DESCRIPTION OF THE DRAWINGS

Further features, advantages and advantageous developments of the invention follow from the following description of an example of an embodiment of the invention, with reference to the drawings attached, in which.

DETAILED DESCRIPTION OF THE PREFERRED EMBODIMENT

Figure 1:
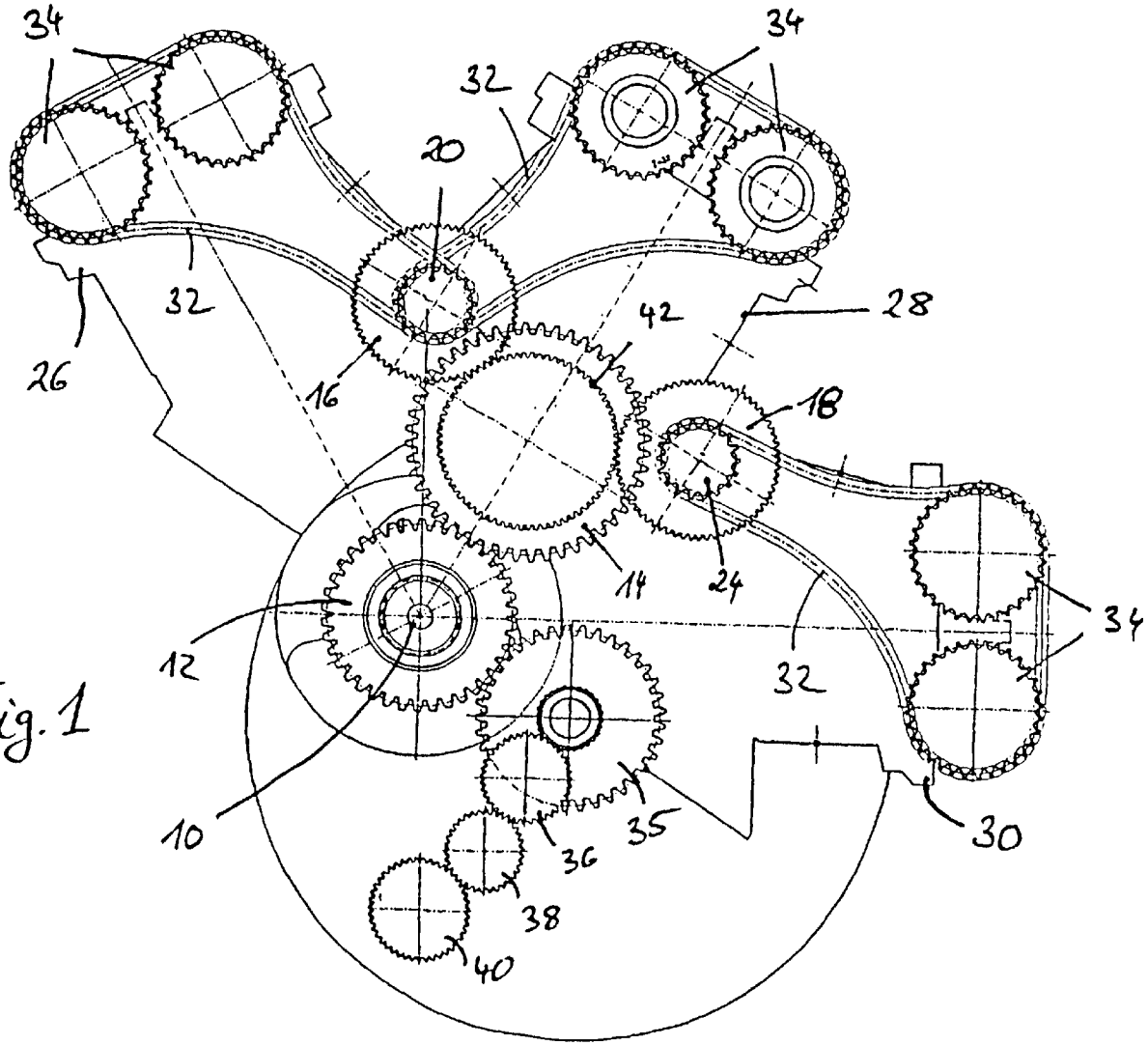
FIG. 1 shows a front view of a preferred embodiment of a control device according to the invention.
Figure 2:
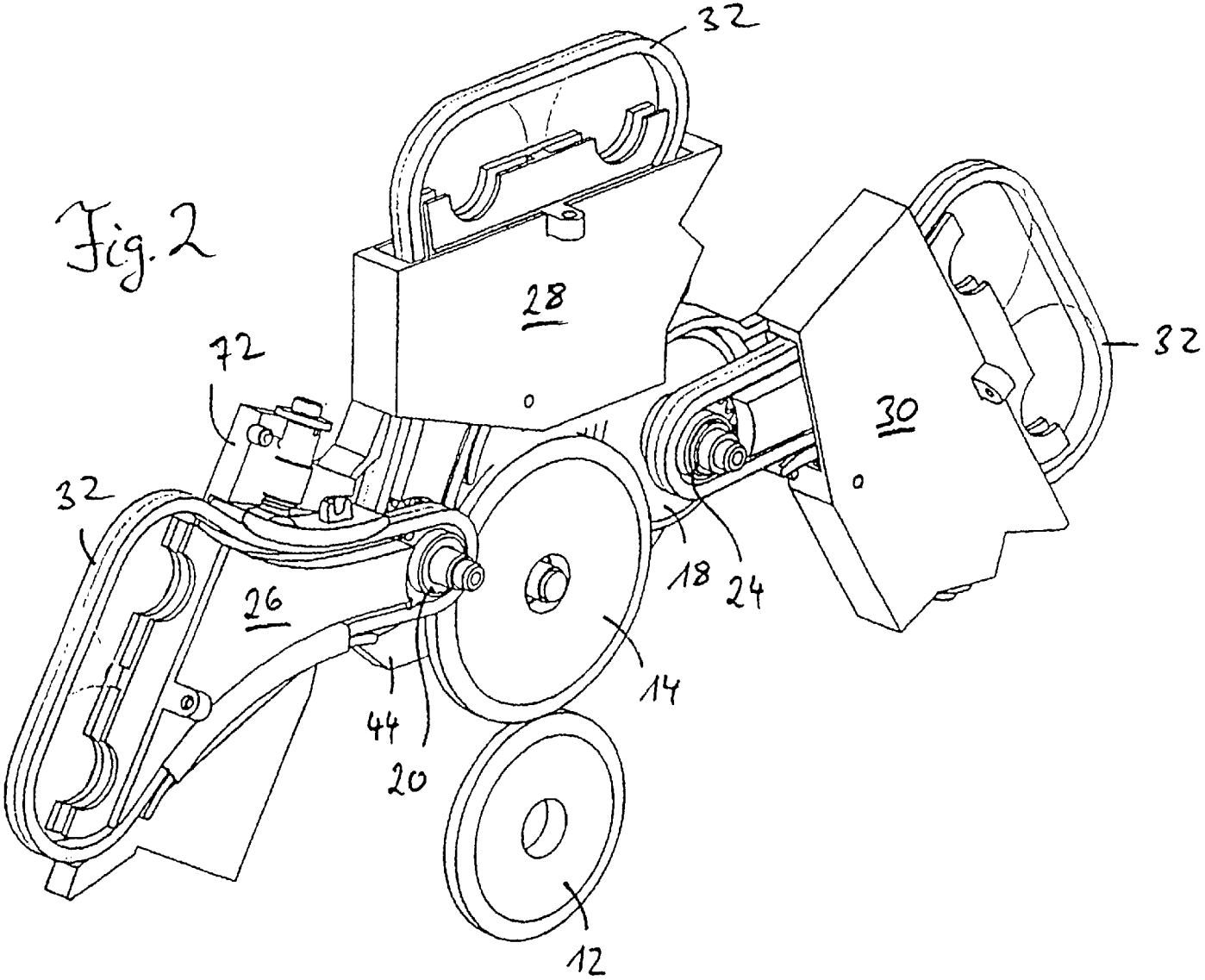
FIG. 2 shows a perspective view thereof.

The preferred embodiment of a control device according to the invention represented in FIGS. 1 and 2 comprises an output gear 12 arranged on a crankshaft 10, which gear intermeshes with a first distributor gear 14. Two secondary distributor gears 16 and 18, which are coaxially arranged and frictionally connected with chain sprockets 20, 22 and 24 of each module 26, 28 and 30 respectively, intermesh with a distributor gear 42, frictionally coupled to the first distributor gear 14, only the intermediate gears 20 and 24 being visible in FIGS. 1 and 2. The chain sprocket 22 is hidden behind the chain sprocket 20 (cf. FIG. 5).

Power is transmitted by way of respective endless-chain drives 32 to each of the camshaft gears 34, which are frictionally connected to corresponding camshafts (not shown). In so doing, the modules 26, 28 and 30 carry the respective chain sprockets 20, 22, 24 at one end and the camshaft gears 34 at an opposite end, the respective endless-chain drive 32 passing around the chain sprockets 20, 22 and 24 and the associated camshaft gears 34. The endless-chain drive 32 results in an essentially vibration-neutralized or vibration-damped power transmission.

In the embodiment represented in FIG. 1, the output gear 12 of the crankshaft 10 also intermeshes with a further distributor gear 36, which by way of a frictionally coupled gear 33 intermeshes with a first intermediate gear 35, which in turn intermeshes with a secondary intermediate gear 38. The secondary intermediate gear 38 in turn intermeshes with a drive gear 40 of an oil pump (not shown), so that the crankshaft 10, by way of its output gear 12, simultaneously drives the oil pump. The distributor gear 35 has, for example, thirty-seven teeth, the first intermediate gear 36 eighteen teeth, the secondary intermediate gear 38 eighteen teeth and the drive gear 40 eighteen teeth.

For the control device, a transmission ratio from the crankshaft 10 to the camshaft gears of 2:1 is needed. This is achieved, for example, by thirty-eight teeth on the output gear 12, sixty-four teeth on a smaller gear rim 42 of the intermediate gear 14, fifty-seven teeth on the secondary distributor gears 16, 18, eighteen teeth on the chain sprockets 20, 22, 24 and thirty-two teeth on the camshaft gears 34.

The embodiment of a control device according to the invention represented in FIGS. 1 and 2 is designed for an internal combustion engine with three rows of cylinders arranged in a V-shaped configuration and denoted below by the letters A, B and C, each module 26, 28 and 30 being assigned to a row of cylinders A, B or C or to a respective camshaft system of a row of cylinders A, B or C. It will be immediately apparent that all three camshaft systems of the three rows of cylinders are actuated by just one distribution system 14, 16, 18.

The arrangement represented by way of example is thereby particularly suitable for a central output for the control device, since in order to bring the control device out away from the crankshaft 10, that is from an inner area of a crankcase (not shown), to the external camshaft gears 34, only one of the rows of cylinders, namely the middle cylinder row B, needs to have a central recess or division. The adjacent rows of cylinders A and C may be designed without a division as continuous cylinder rows A and C. The camshaft gears 34 of the two adjacent rows of cylinders A and C are actuated by the modules 26 and 30 likewise proceeding from the middle row of cylinders B.

Figure 3:
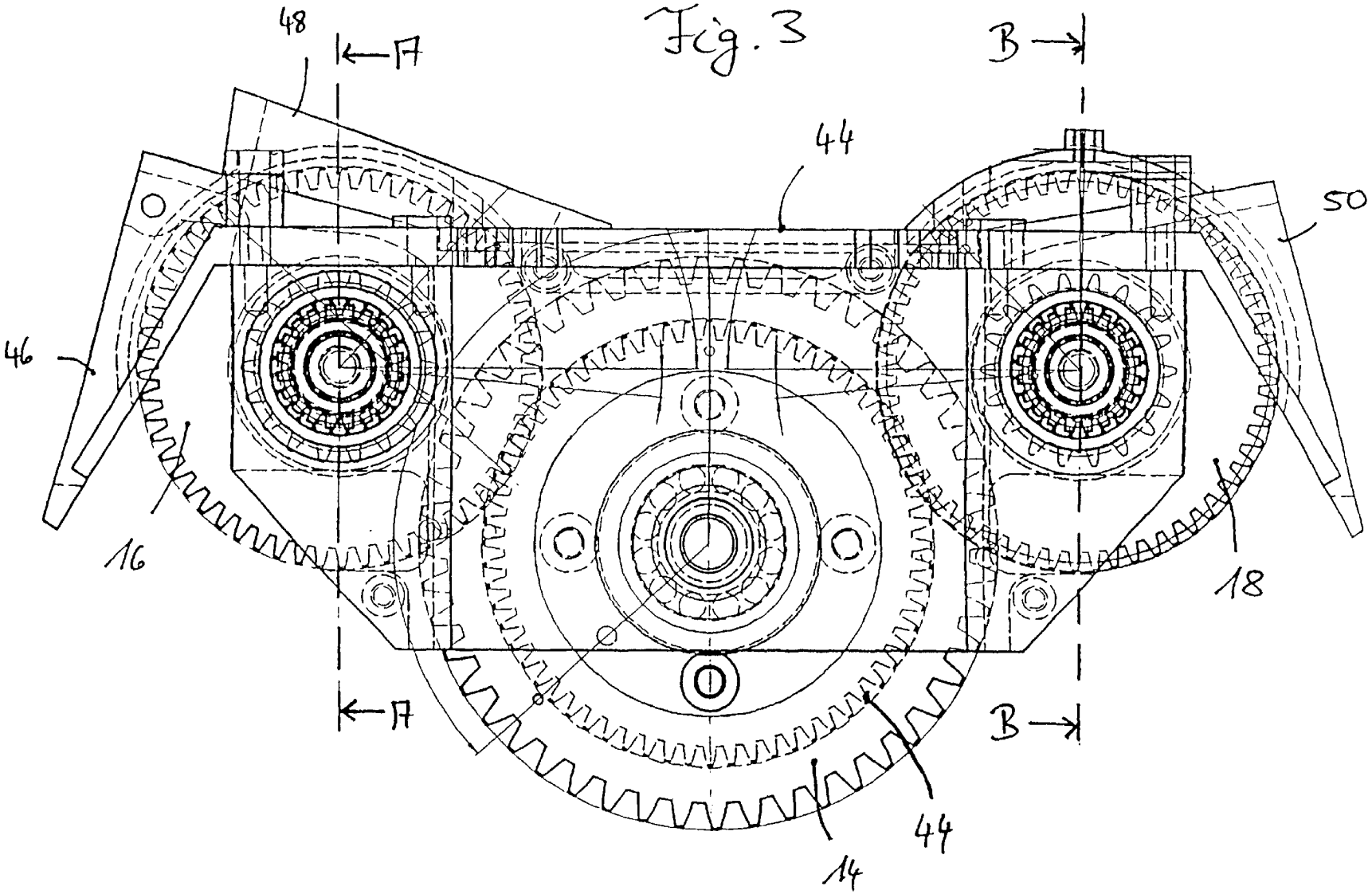
FIG. 3 shows a front view of a carrier for a distribution system of a control device according to the invention.
Figure 4:
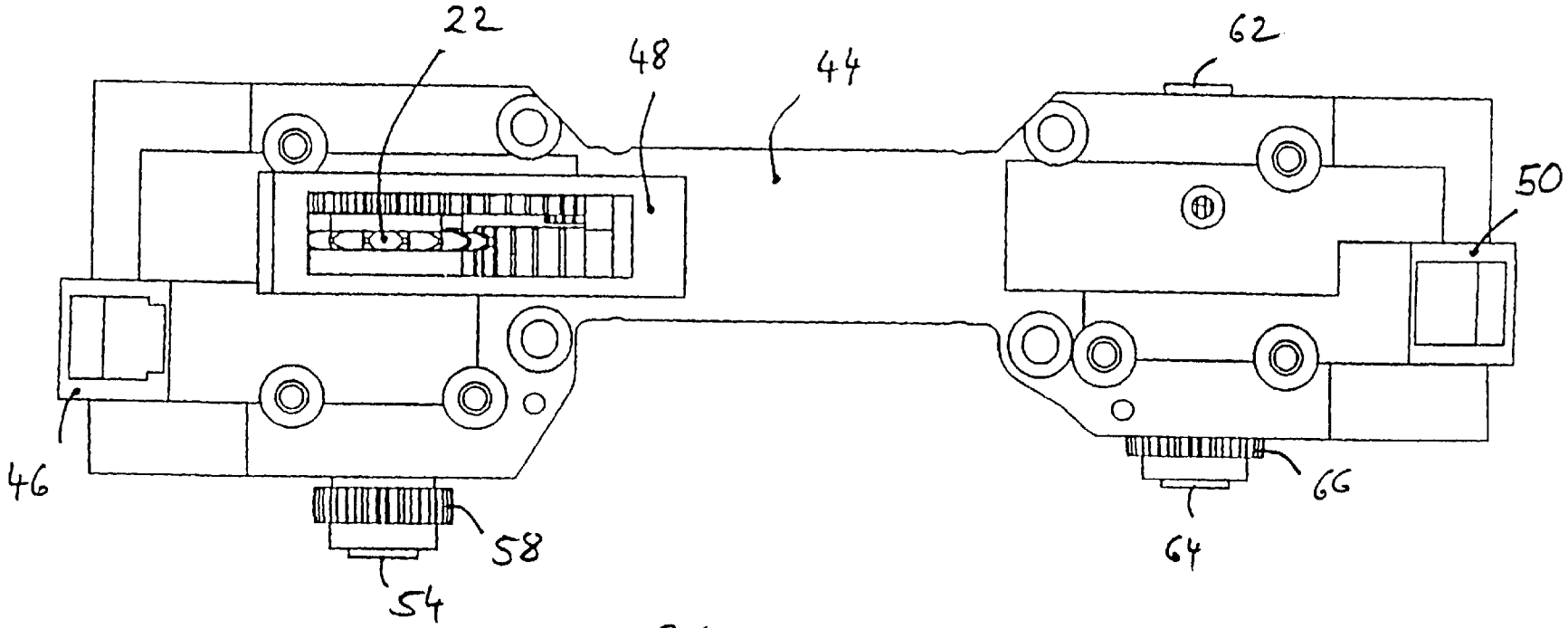
FIG. 4 shows a top view thereof.

The first and the secondary distributor gears 14, 16 and 18 are arranged in a common carrier 44, as can be seen from FIGS. 3 and 4. Said carrier 44 holds the first distributor gear 14 and the secondary distributor gears 16 and 18, it being possible, for example, to insert the pre-assembled carrier into a recess or division in the middle bank of cylinders B and to bolt it to the crankcase. Respective insertion guides 46, 48 and 50 for each of the modules 26, 28 and 30 are furthermore formed on the carrier 44. After fixing the carrier 44 on the crankcase, the modules 26, 28 and 30 each with pre-assembled chain sprockets 20, 22 and 24 together with pre-assembled camshaft gears 34 and endless-chain drive 32 can be inserted into said insertion guides 46, 48 and 50. As soon as all gears are at their predetermined location, they can be rotatably fixed to the corresponding shaft and bearings.

Figure 5:
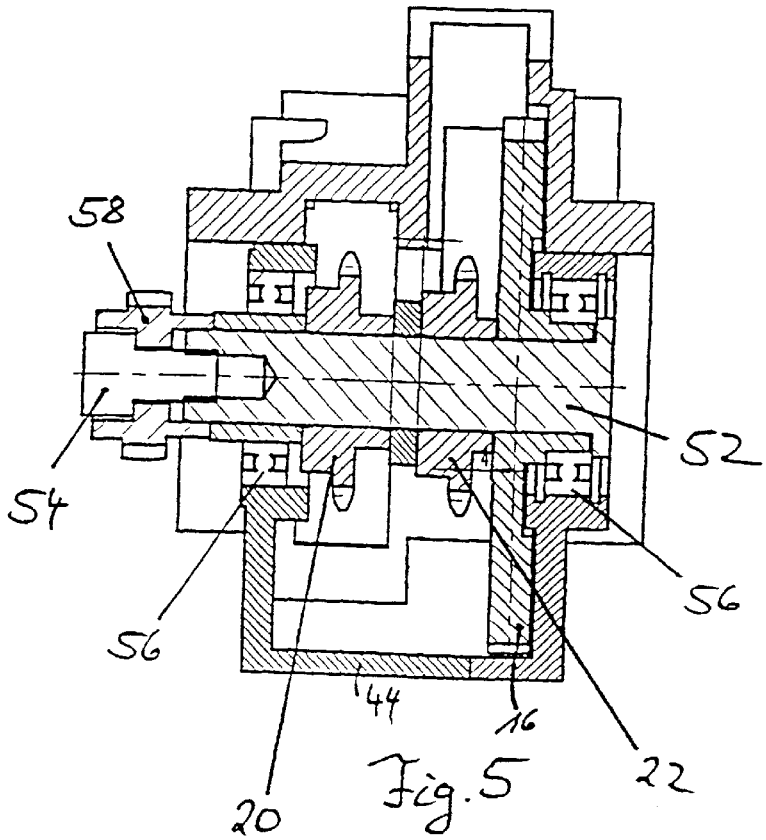
FIG. 5 shows a sectional view along the line A—A in FIG. 3.

This is the case for the chain sprockets 20, 22 together with the secondary distributor gear 16 in FIG. 5. When fitted on a common shaft 52, these gears 16, 20 and 22 are non-positively connected to one another by frictional adhesion, a central bolt 54 fixing this arrangement. The shaft 52 is mounted so that it can rotate by means of ball bearings 56 in relation to the carrier 44. The central bolt furthermore fixes a gear 58, which serves as drive for a water pump (not shown).

Figure 6:
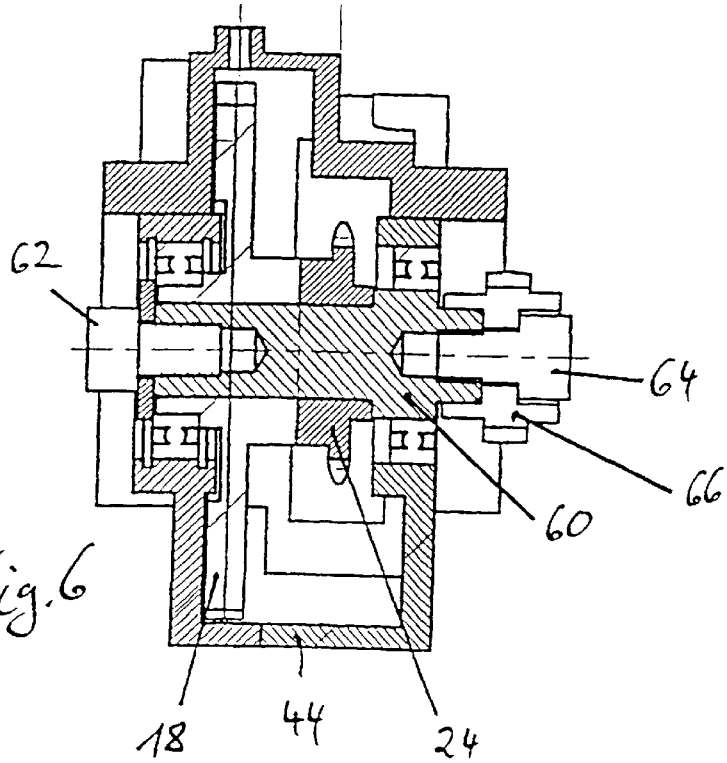
FIG. 6 shows a sectional view along the line B—B in FIG. 3

FIG. 6 illustrates the arrangement of the secondary distributor gear 18 with the chain sprocket 24 in the assembled state. In this case, a shaft 60 is provided, which is fixed by two central bolts 62 and 64. The central bolt 64 furthermore fixes a gear 66, which serves for a drive for a further water pump (not shown). The two aforementioned water pumps are, for example, arranged directly adjacent to the carrier 44 in respective V-shaped intermediate spaces between the rows of cylinders A and B or B and C in such a way that their drive gears intermesh directly with each of the gears 58 and 66 respectively.

Figure 7:
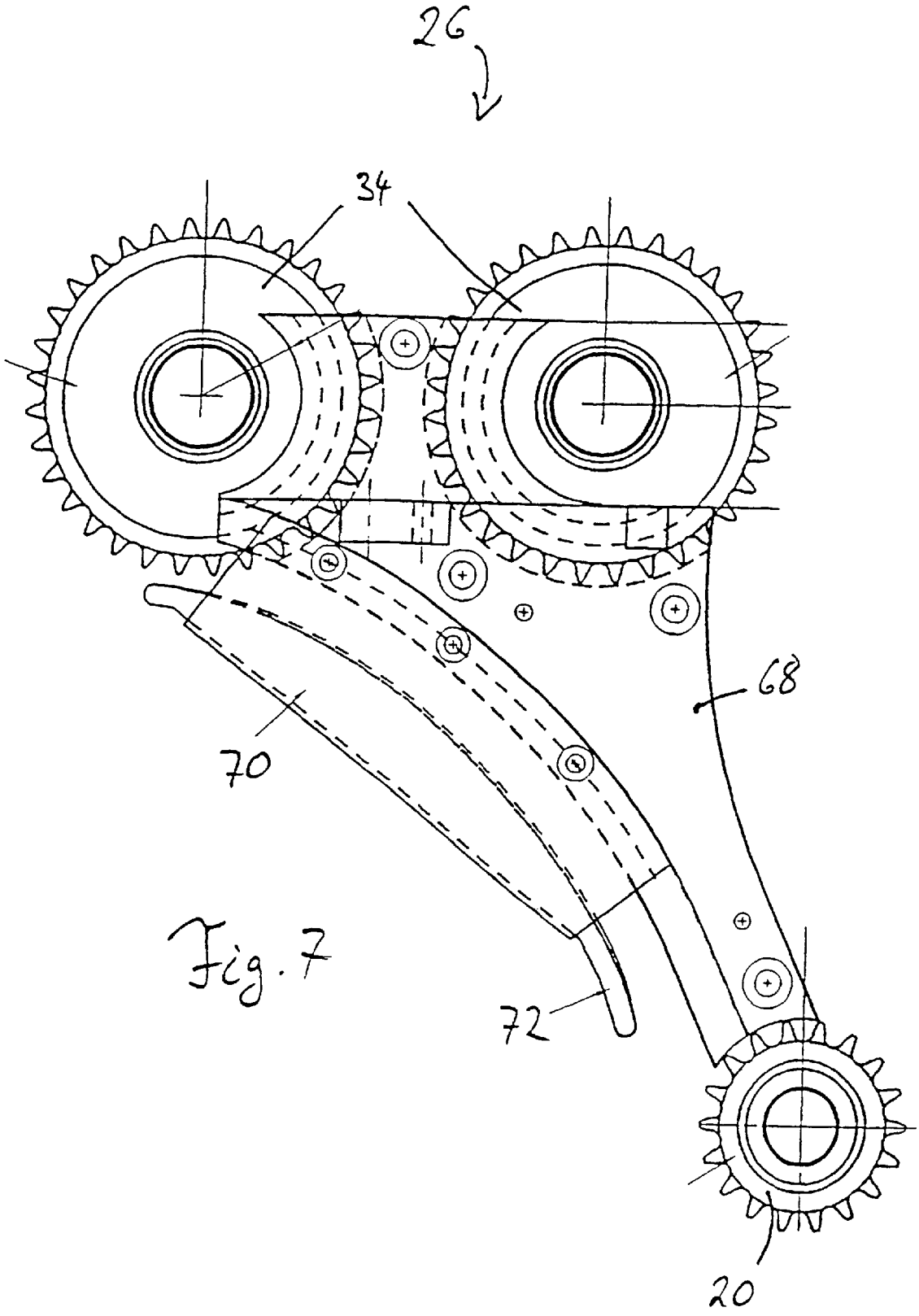
FIG. 7 shows a side view of a module of a control device according to the invention.

FIG. 7 illustrates, by way of example, the module 26 for cylinder row A. Said module 26 comprises a frame 68 and a U-shaped guide plate 70 on the idle strand side with a running surface 72 for the chain of the endless-chain drive, not shown in FIG. 7. When pre-assembled, the chain passes around the chain sprocket 20 and the camshaft gears 34 and holds these fast to the frame 68, no further fixing of any kind being otherwise provided for the chain sprocket 20 and the camshaft gears 34. Only after fitting or inserting the modules 26, 28 and 30 are these finally rotatably fixed by means of corresponding shafts, such as the aforementioned shafts 52 and 60 for the chain sprockets 20, 22 and 24, for example. A chain tensioning fixture 72, for example, is provided on the load strand side, as can be seen from FIG. 2.

We claim:

1. A control device for camshaft systems of an internal combustion engine with a crankshaft and n banks of cylinders arranged in a V-shaped configuration, the control device comprising: a distribution system with a first distributor gear; an output gear arranged on the crankshaft so as to intermesh with the first distributor gear, the distributor system having $m<n$ secondary distributor gears which intermesh with the first distributor gear; and n endless-chain drives operatively connected to the secondary distribution gears and the camshaft systems so as to transmit a driving force to the n camshaft systems of the n banks of cylinders.

2. A control device as defined in claim 1, wherein the drive gear is arranged centrally on the crankshaft.

3. A control device as defined in claim 1, wherein $m=n-1$.

4. A control device as defined in claim 1 wherein $m=n-2$.

5. A control device as defined in claim 1, wherein $n=2$.

6. A control device as defined in claim 1, wherein $n=3$.

7. A control device as defined in claim 1, wherein $n=4$.

8. A control device as defined in claim 5, wherein the first distributor gear and the secondary distributor gears are arranged in a common carrier which is fixable to a crankcase of the internal combustion engine.

9. A control device as defined in claim 1, and further comprising a module that carries the endless-chain drive provided between each secondary distributor gear and each camshaft system, the module being preassembled so as to carry a chain sprocket, which is frictionally and coaxially fittable to the respective secondary distributor gear, at one end and at least one camshaft gear on an opposite end, the endless-chain drive passing around the chain sprocket and the camshaft gear.

10. A control device as defined in claim 9, wherein a tooth ratio of the secondary distributor gear to the chain sprocket is such that a crankshaft to camshaft system transmission ratio of 2:1 is obtained.

11. A control device as defined in claim 9, wherein the module has a U-shaped guide plate for the endless-drive on an idle strand side.

12. A control device as defined in claim 9, wherein the module has a chain-tensioning fixture on a load strand side.

13. A combination comprising: an internal combustion engine having a crankshaft, cam shaft systems and n banks of cylinders arranged in a V-shaped configuration; and a control device for the camshaft systems, the control device including a distribution system with a first distributor gear, an output gear arranged on the crankshaft so as to intermesh with the first distributor gear, the distribution system having $m<n$ secondary distributor gears which intermesh with the first distributor gear, and n endless-chain drives operatively connected to the secondary distribution gears and the camshaft system so as to transmit a driving force to the n camshaft systems of the n banks of cylinders.

* * * * *